United States Patent [19]

Holbrook et al.

[11] Patent Number: 4,981,037

[45] Date of Patent: Jan. 1, 1991

[54] METHOD FOR DETERMINING PORE PRESSURE AND HORIZONTAL EFFECTIVE STRESS FROM OVERBURDEN AND EFFECTIVE VERTICAL STRESSES

[75] Inventors: Phil Holbrook, Houston; Homer A. Robertson, Woodlands; Michael L. Hauck, Houston, all of Tex.

[73] Assignee: Baroid Technology, Inc., Houston, Tex.

[21] Appl. No.: 868,317

[22] Filed: May 28, 1986

[51] Int. Cl.[5] ..... E21B 49/00

[52] U.S. Cl. ..... 73/152; 166/250; 175/50

[58] Field of Search ..... 175/50; 73/151, 152; 166/250

[56] References Cited

U.S. PATENT DOCUMENTS 3,907,034 9/1935 Suman, Jr. ..... 175/50

4,635,719 1/1987 Zoback et al. ..... 75/155

OTHER PUBLICATIONS

"Petrophysical-Mechanical Math Model for Real--Time Wellsite Pore Pressure/Fracture Gradient Prediction" by Philip Holbrook and Michael Hauck, SPE 16666, Copyright 1987 for presentation at 62nd Annual Technical Conference and Exhibition of the Society of Petroleum Engineers held in Dallas, TX on Sep. 27-30, 1987.

*Primary Examiner*—Hezron E. Williams

*Attorney, Agent, or Firm*—Browning, Bushman, Anderson & Brookhart

[57] ABSTRACT

The porosity-effective stress relationship, which is a fuction of lithology, is used to calculate total overburden stress, vertical effective stress, horizontal effective stress and pore pressure using well log data. The log data can be either real time data derived from measurement-while-drilling equipment or open hole wireline logging equipment.

4 Claims, 2 Drawing Sheets

FIG. 1
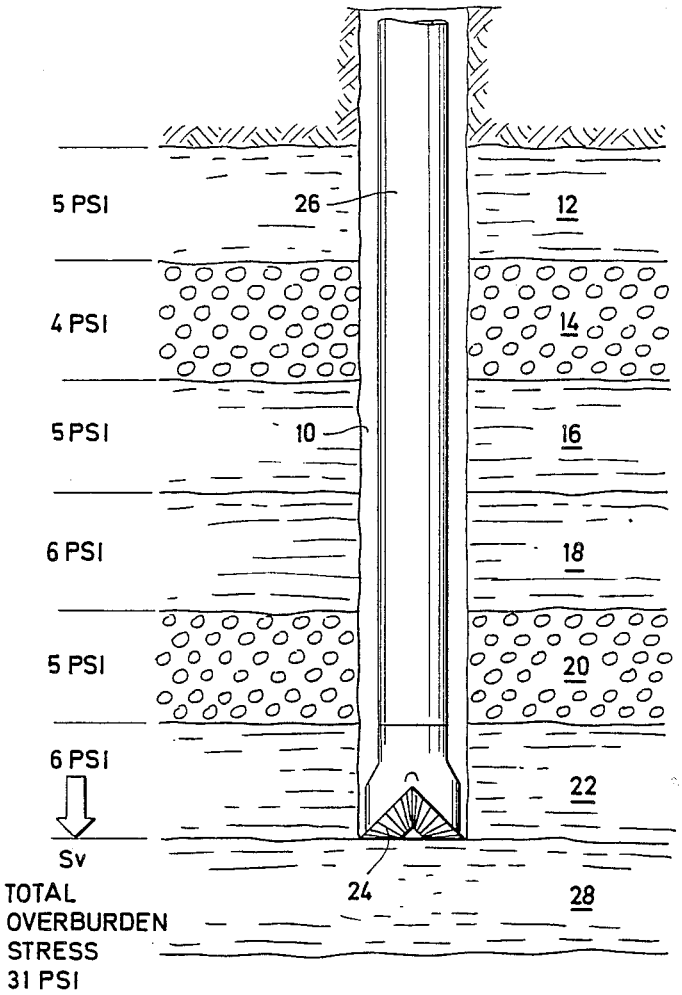
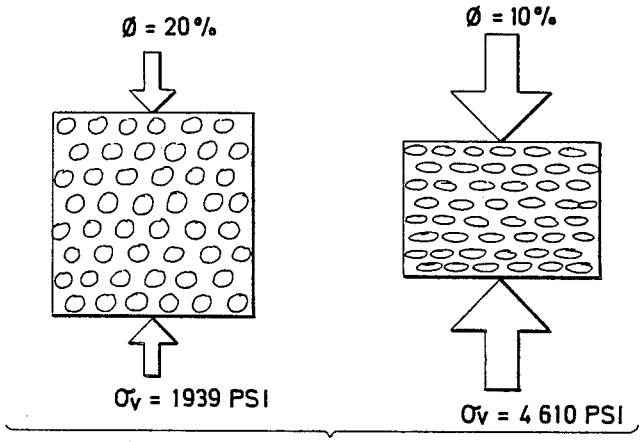
FIG. 2

METHOD FOR DETERMINING PORE PRESSURE AND HORIZONTAL EFFECTIVE STRESS FROM OVERBURDEN AND EFFECTIVE VERTICAL STRESSES

BACKGROUND OF THE INVENTION

1. Field of the Invention

The present invention relates to a method for determining in situ earth stresses and pore pressure and in particular to a method in which the overburden stress, vertical effective stress, horizontal effective stress and pore pressure are estimated from well log data.

2. The Prior Art

The estimation or determination of pore fluid pressure is a major concern in any drilling operation. The pressure applied by the column of drilling fluid must be great enough to resist the pore fluid pressure in order to minimize the chances of a well blowout. Yet, in order to assure rapid formation penetration at an optimum drilling rate, the pressure applied by the drilling fluid column must not greatly exceed the pore fluid pressure. Likewise, the determination of horizontal and vertical effective stresses is important in designing casing programs and determining pressures due to drilling fluid at which an earth formation is likely to fracture.

The commonly-used techniques for making pore pressure determinations have relied on the use of overlay charts to empirically match well log data to drilling fluid weights used in a particular geological province. These techniques are semi-quantitative, subjective and unreliable from well to well. None are soundly based upon physical principles.

Effective vertical stress and lithology are the principal factors controlling porosity changes in compacting sedimentary basins. Sandstones, shales, limestones, etc. compact at different rates under the same effective stress. An effective vertical stress log is calculated from observed or calculated porosity for each lithology with respect to a reference curve for that lithology.

The previous techniques for determining in situ earth stresses have relied on strain-measuring devices which are lowered into the well bore. None of these devices or methods using these devices use petrophysical modeling to determine stresses from well logs. They are unsuitable for overburden stress calculations because the various shales hydrate after several days of exposure to drilling fluid and thus change their apparent porosity and pressure.

There have been many attempts to detect pore pressure using various physical characteristics of the borehole. For example, U.S. Pat. No. 3,921,732 describes a method in which the geopressure and hydrocarbon containing aspects of the rock strata are detected by making a comparison of the color characteristics of the liquid recovered from the well. U.S. Pat. No. 3,785,446 discloses a method for detecting abnormal pressure in subterranean rock by measuring the electrical characteristics, such as resistivity or conductivity. This test is conducted on a sample removed from the borehole and must be corrected for formation temperature, depth and drilling procedure. U.S. Pat. No. 3,770,378 teaches a method for detecting geopressures by measuring the total salinity or elemental cationic concentration. This is a chemical approach to attempting a determination of pressure. A somewhat similar technique is taught in U.S. Pat. No. 3,766,994 which measures the concentration of sulfate or carbonate ions in the formation and observes the degree of change of the ions present with depth drilling procedures being taken into consideration. U.S. Pat. No. 3,766,993 discloses another chemical method for detecing subsurface pressures by measuring the concentration of bicarbonate ion in the formation being drilled. U.S. Pat. No. 3,722,606 concerns another method for predicting abnormal pressure by measuring the tendency of an atomic particle to escape from a sample. Variations in rate of change of escape with depth indicates that the drilling procedures ought to be modified for the formation about to be penetrated. U.S. Pat. No. 3,670,829 concerns a method for determing pressure conditions in a well bore by measuring the density of cutting samples returned to the surface. U.S. Pat. No. 3,865,201 discloses a method which requires periodically stopping the drilling to observe the acoustic emissions from the formation being drilled and then adjusting the weight of the drilling fluid to compensate for pressure changes discovered by the acoustical transmissions.

SUMMARY OF THE INVENTION

The present invention is a method for calculating total overburden stress, vertical effective stress, pore pressure and horizontal effective stress from well log data. The subject invention can be practiced on a real-time basis by using measurement-while-drilling techniques or after drilling by using recorded data or open-hole wireline data. The invention depends upon a porosity-effective stress relationship, which is a function of lithology, to calculate the above-mentioned stresses and pressure rather than upon finding a particular regional empirical curve to fit the data. Overburden stress can also be calculated from any form of integrated pseudo-density log derived from well log data. The invention calculates total overburden stress, vertical effective stress, pore pressure and horizontal effective stress continuously within a logged interval. Thus, it is free from regional and depth range restrictions which apply to all of the known prior art methods.

BRIEF DESCRIPTION OF THE DRAWINGS

The present invention will now be described by way of example with reference to the accompanying drawings in which:

FIG. 1 is a schematic vertical section through a typical borehole showing representative formations which together form the overburden;

FIG. 2 is a diagrammatic representation of how vertical effective stress is determined by the present invention;

DETAILED DESCRIPTION OF THE PREFERRED EMBODIMENT

Figure 3:
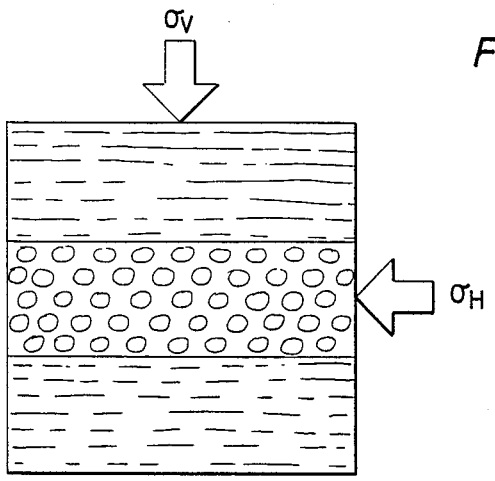
FIG. 3 is a diagrammatic representation of how horizontal effective stress is determined by the present invention.

Pore fluid pressure is a major concern in any drilling operation. Pore fluid pressure can be defined as the isotropic force per unit area exerted by the fluid in a porous medium. Many physical properties of rocks (compressibility, yield strength, etc.) are affected by the pressure of the fluid in the pore space. Several natural processes (compaction, rock diagenesis and thermal expansion) acting through geological time influence the pore fluid pressure and in situ stresses that are observed in rocks today. FIG. 1 schematically illustrates a representative borehole drilling situation. A borehole 10 has been drilled through consecutive layered formations 12, 14, 16, 18, 20, 22 until the drill bit 24 on the lower end of drill string 26 is about to enter formation 28. An arbitrary amount of stress has been indicated for each formation for illustrative purposes only.

One known relationship among stresses is the Terzaghi effective stress relationship in which the total stress equals effective stress plus pore pressure ($S=_{v}+P$). The present invention uniquely applies this relationship to well log data to determine pore pressure. Total overburden stress and effective vertical stress estimates are made using petrophysically based equations relating stresses to well log resistivity, gamma ray and/or porosity measurements. This technique can be applied using measurement-while-drilling logs, recorded logs or open hole wireline logs. The derived pressure and stress determination can be used real-time for drilling operations or afterward for well planning and evaluation.

Total overburden stress is the vertical load applied by the overlying formations and fluid column at any given depth. The overburden above the formation in question is estimated from the integral of all the material (earth sediment and pore fluid, i.e. the overburden) above the formation in question. Bulk weight is determined from well log data by applying petrophysical modeling techniques to the data. When well log data is unavailable for some intervals, bulk weight is estimated from average sand and shale compaction functions, plus the water column within the interval.

The effective vertical stress and lithology are principal factors controlling porosity changes in compacting sedimentary basins. Sandstones, shales, limestones, etc. compact differently under the same effective stress $\sigma_v$. An effective vertical stress log is calculated from porosity with respect to lithology. Porosity can be measured directly by a well logging tool or can be calculated indirectly from well log data such as resistivity, gamma ray, density, etc.

Effective horizontal stress and lithology are the principal factors controlling fracturing tendencies of earth formations. Various lithologies support different values of horizontal effective stress given the same value of vertical effective stress. An effective horizontal stress log and fracture pressure and gradient log is calculated from vertical effective stress with respect to lithology. A non-elastic method is used to perform this stress conversion.

Pore pressures calculated from resistivity, gamma ray and/or normalized drilling rate are usually better than those estimated using shale resistivity overlay methods. When log quality is good, the standard deviation of unaveraged effective vertical stress is less than 0.25 ppg. Resulting pore pressure calculations are equally precise, while still being sensitive to real changes in pore fluid pressure. Prior art methods for calculating pore pressure and fracture gradient provide values within 2 ppg of the true pressure.

The present invention utilizes only two input variables (calculated or measured directly), lithology and porosity, which are required to estimate pore fluid pressure and in situ stresses from well logs.

The total overburden stress ($S_v$) is the force resulting from the weight of overlying material, schematically shown in FIG. 1, e.g.

$$S_v = \int_{\text{depth}}^{\text{surface}} [\rho_{matrix}(1-\phi) + \rho_{fluid}(\phi)]g\,dz \tag{1}$$

where $g$=gravitational constant and $\phi$=fluid filled porosity;

$\rho_{matrix}$=density of the solid portion of the rock which is a function of lithology;

$\rho_{fluid}$=density of the fluid filling the pore space.

Typical matrix densities are 2.65 for quartz sand; 2.71 for limestone; 2.63 to 2.96 for shale; and 2.85 for dolomite, all depending upon lithology.

Effective vertical stress is that portion of the overburden stress which is borne by the rock matrix. The balance of the overburden is supported by the fluid in the pore space. This principal was first elucidated for soils in 1923 and is applied to earth stresses as measured from well logs by this invention. The functional relationship between effective stress and porosity was first elucidated in 1957. The present invention combines these concepts by determining porosity from well logs and then using this porosity to obtain vertical effective stress using the equation:

$$\sigma_v = \sigma_{max} S^{\alpha+1} \tag{2}$$

where $\sigma_{max}$=theoretical maximum vertical effective stress at which a rock would be completely solid. This is a lithology-dependent constant which must be determined empirically, but is typically 8,000 to 12,000 psi for shales, and 12,000 to 16,000 psi for sands.

$\alpha$=compaction exponent relating stress to strain. This must also be determined empirically, but is typically 6.35.

S=solidity=1−porosity $\sigma_v$=vertical effective stress.

The effect of vertical stress is diagrammatically shown in FIG. 2. Both sides represent the same mass of like rock formations. The lefthand side represents a low stress condition, for example less than 2000 psi, and a porosity of 20% giving the rock a first volume. The righthand side represents a high stress condition, for example greater than 4,500 psi, yielding a lower porosity of 10% and a reduced second volume. Clearly, the difference in the two samples is the porosity which is directly related to the vertical stress of the overburden.

Horizontal effective stress is related to vertical effective stress as it developed through geological time. The relationship between vertical and horizontal stresses is usually expressed using elastic or poro-elastic theory, which does not take into consideration the way stresses build up through time. The present invention uses visco-plastic theory to describe this time-dependent relationship. The equation relating vertical effective stress to horizontal effective stress is:

$$\sigma_H = -\left\{ \frac{-\frac{1}{2}\sigma_v^2 + 2\alpha^2\sigma_v^2 + 12\alpha\kappa\sigma_v + 18\kappa^2}{1-8\alpha^2} + \right. \tag{3}$$

-continued $$\left[-\frac{1}{2}\frac{(23\alpha\kappa + 8\alpha^2\sigma_v)}{1 - 8\alpha^2}\right]^2\Bigg\}^{\frac{1}{2}} + \frac{1}{2}\frac{(24\alpha\kappa + 8\alpha^2\sigma_v)}{1 - 8\alpha^2}$$

where $\sigma_H$=effective horizontal stress $\sigma_v$=effective vertical stress $\alpha$=dilatency factor $\kappa$=coefficient of strain hardening The constants $\alpha$ and $\kappa$ are lithology-dependent and must be determined empirically. Typical values of $\kappa$ range from 0.0 to 20, depending upon lithology, while $\alpha$ typically ranges from 0.26 to 0.32, depending upon lithology. The horizontal stress is shown diagrammatically in FIG. 3.

Figure 4:
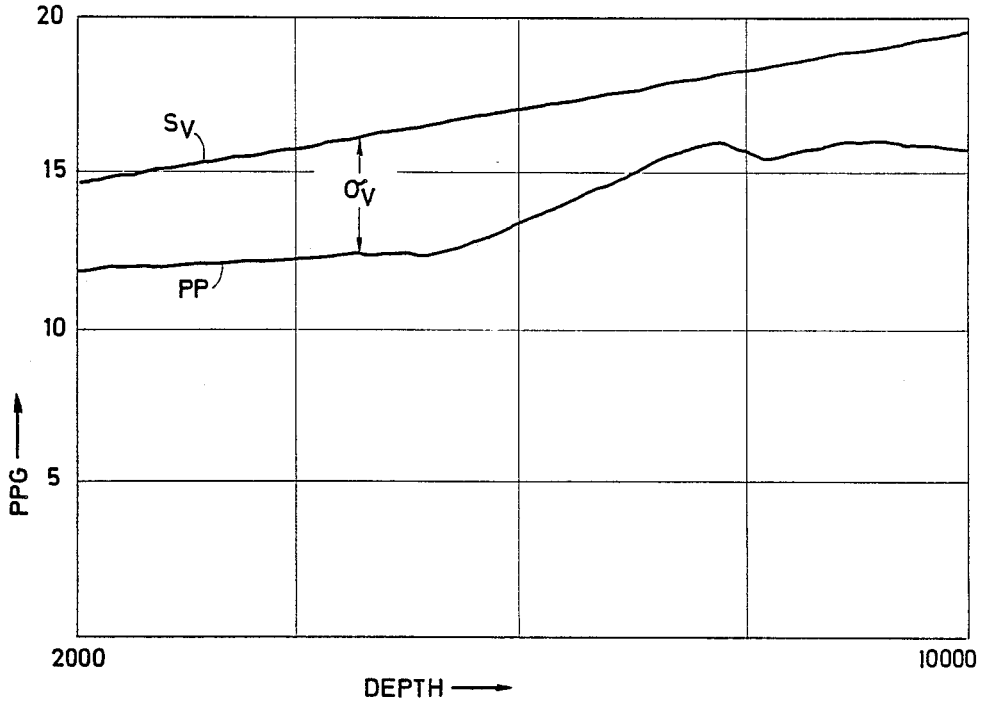
FIG. 4 is a graphic representation of how pore pressure and fracture pressure are determined by the present invention.

The present invention calculates vertical effective stress from porosity, and total overburden stress from integrated bulk weight of overlying sediments and fluid. Given these two stresses, pore pressure is calculated by by determining the difference between the two stresses. This is graphically illustrated in FIG. 4 with the vertical effective stress being the difference between total overburden stress and pore pressure. Effective horizontal stress is calculated from vertical effective stress. Fracture pressure of a formation is almost the same as the horizontal effective stress.

The foregoing disclosure and description of the invention is illustrative and explanatory thereof, and various changes in the method steps may be made within the scope of the appended claims without departing from the spirit of the invention.

What is claimed is:

1. A method for determining pore pressure in an in situ subsurface formation, comprising the steps of:

causing a well logging tool to traverse an earth borehole between the earth's surface and said subsurface formation;

determining the total overburden stress resulting from the integrated weight of material overlying said subsurface formation between the earth's surface and said subsurface formation, said overburden stress determining step being a function of the density of the solid rock portion and of the density of the fluid filling the pore spaces in the said overlying materials as measured, at least in part, by said well logging tool;

determining the vertical effective stress in said subsurface formation from porosity logs, said porosity logs being generated by said well logging tool as said tool traverses said earth borehole through said subsurface formation; and generating a pore pressure log indicative of the difference between said overburden stress and said vertical effective stress.

2. The method according to claim 1 wherein said vertical effective stress is determined from $\sigma_v = {}^{\sigma}\max^{(1-\phi)^{1+\alpha}}$, where ${}^{\sigma}{}_v$=vertical effective stress, $\sigma_{max}$=theoretical maximum vertical effective stress, $\phi$=fluid filled porosity, and $\alpha$=compaction exponent relating stress to strain.

3. The method according to claim 2 wherein said $\sigma$ max is determined from lithology logs generating by said well logging tool as said tool traverse said earth borehole through said subsurface formation.

4. The method according to claim 1, being characterized further by the additional step of determining the effective horizontal stress at said subsurface formation using lithology logs generated, at least in part, by said well logging tool as said tool traverses said earth borehole through said subsurface formation.

* * * * *